US008721362B2

(12) United States Patent
Kato et al.

(10) Patent No.: US 8,721,362 B2
(45) Date of Patent: May 13, 2014

(54) CONNECTION MEMBER, METHOD OF MANUFACTURING THE SAME AND CONNECTION STRUCTURE

(75) Inventors: Kohei Kato, Chiryu (JP); Fumitoshi Akaike, Miyoshi (JP)

(73) Assignee: Toyota Boshoku Kabushiki Kaisha, Aichi-Ken (JP)

( * ) Notice: Subject to any disclaimer, the term of this patent is extended or adjusted under 35 U.S.C. 154(b) by 59 days.

(21) Appl. No.: 13/313,595

(22) Filed: Dec. 7, 2011

(65) Prior Publication Data

US 2012/0156926 A1 Jun. 21, 2012

(30) Foreign Application Priority Data

Dec. 15, 2010 (JP) ..... 2010-279701

(51) Int. Cl.
*H01R 11/00* (2006.01)

(52) U.S. Cl.
USPC ..... 439/502

(58) Field of Classification Search
USPC ..... 439/502; 174/117 M, 86 R, 255, 126.1, 174/84 R; 361/774, 805
See application file for complete search history.

(56) References Cited

U.S. PATENT DOCUMENTS

| | | | | |
|---|---|---|---|---|
| 3,056,005 | A * | 9/1962 | Larson | 200/86 R |
| 3,396,252 | A * | 8/1968 | Serizawa et al. | 200/86 R |
| 3,447,120 | A * | 5/1969 | Rask et al. | 439/497 |
| 3,479,565 | A * | 11/1969 | Rask et al. | 361/809 |
| 3,513,297 | A * | 5/1970 | Jordan | 219/545 |
| 4,538,054 | A * | 8/1985 | de la Bretoniere | 219/545 |
| 6,723,967 | B2 * | 4/2004 | Rock et al. | 219/528 |
| 7,230,610 | B2 * | 6/2007 | Jung et al. | 345/173 |
| 8,169,329 | B2 * | 5/2012 | Koblasz et al. | 340/573.5 |
| 2007/0145030 | A1 | 6/2007 | Wu | |
| 2009/0062897 | A1 * | 3/2009 | Axelgaard | 607/152 |
| 2010/0096899 | A1 | 4/2010 | Kato et al. | |
| 2010/0101858 | A1 | 4/2010 | Kato et al. | |
| 2010/0258334 | A1 | 10/2010 | Akaike et al. | |
| 2011/0278282 | A1 | 11/2011 | Kato et al. | |
| 2011/0284515 | A1 | 11/2011 | Akaike et al. | |

FOREIGN PATENT DOCUMENTS

| | | |
|---|---|---|
| JP | 2004-33730 | 2/2004 |
| JP | 3119584 | 3/2006 |
| JP | 2006-127779 | 5/2006 |

(Continued)

OTHER PUBLICATIONS

Japanese Office Action dated Jan. 14, 2014, along with English-language translation thereof.

*Primary Examiner* — Jean F Duverne
(74) *Attorney, Agent, or Firm* — Greenblum & Bernstein, P.L.C.

(57) ABSTRACT

A connection member which is electrically connected to a conductive fabric having conductive threads, a method for manufacturing the connection member, and a connection structure are provided. The connection member includes a band-shaped part including conductive wires which extend in a longitudinal direction, and a connection terminal which is attached to an end portion of the conductive wires. The method includes forming an original band-shaped member by weaving while using the conductive wires for a part of warp and using at least non-conductive threads for weft; exposing the conductive wires at an end portion of the original band-shaped member; and attaching a connection terminal to the exposed conductive wires. The connection structure includes the conductive fabric and the connection member, and the conductive wires of the connection member are electrically connected to the conductive threads exposed from the conductive fabric.

6 Claims, 3 Drawing Sheets

(56) References Cited

FOREIGN PATENT DOCUMENTS

| | | |
|---|---|---|
| JP | 2010-95144 | 4/2010 |
| JP | 2010-131970 | 6/2010 |
| JP | 2010-261143 | 11/2010 |
| WO | 2009/075676 | 6/2009 |

* cited by examiner

CONNECTION MEMBER, METHOD OF MANUFACTURING THE SAME AND CONNECTION STRUCTURE

BACKGROUND OF THE INVENTION

1. Field of the Invention

The present invention relates to a connection member, a method of manufacturing the same and a connection structure.

2. Description of the Related Art

Conventionally, there have been known a variety of heater members in which conductive threads are used for a part of threads configuring woven and knitted fabrics and electric current is applied to the conductive threads to generate heat and to thus increase the temperature. The heater members are used for various applications. For example, a seat for a vehicle, particularly automobile has been known in which a heater member is adhered on a backside of a covering material such as seat cushion and can warm a passenger from a lower side and the like under low temperature conditions such as in winter. In addition, the heater member is configured such that an end portion of the heater member is connected with a connection member, conductive threads of a conductive fabric are electrically connected to conductive wires of the connection member and the electric current is applied from a power supply to the conductive threads via the conductive wires, so that the conductive threads generate heat and the temperature of the conductive fabric is thus increased.

As described above, members having various structures have been known, as the connection member that is connected to apply the electric current to the conductive fabric and to thus increase the temperature thereof. For example, a heat generation and retention member has been known which has a first conductor, a second conductor having a resistance value smaller than that of the first conductor and provided on the first conductor and a power supply wire connected to the second conductor (for example, refer to JP-UM-A-3119584). JP-UM-A-3119584 describes that the entire heat generation surface uniformly generates heat and does not burn the covering material due to the local high temperatures. Also, a heat generation seat has been known in which nichrome wires serving as electrodes are enclosed at both ends of a fiber product having conductivity and electrode plates are connected to ends of the electrodes (for example, refer to JP-A-2006-127779).

However, if the heat generation and retention member described in the above JP-UM-A-3119584 is used as the heater member of a vehicle seat, when the covering material, to which the heat generation and retention member is adhered, and the other covering material are sewn to manufacture a seat cover, the power supply wire, which is connected to the second conductor in advance, becomes an obstacle, so that it is difficult to handle. Also, it is not easy to connect the power supply wire after manufacturing the seat cover. Further, according to the heat generation seat described in JP-A-2006-127779, the nichrome wires (connection members) are enclosed at both ends of the fiber product and then the electrode plates are connected to the ends of the wires. Accordingly, when the electrode plates are connected after manufacturing the seat cover, it is not easy to perform the connection operation.

SUMMARY OF THE INVENTION

The present invention has been made in view of the above circumstances, and an object of the present invention is to provide a connection member for feeding power to conductive threads of a conductive fabric, a method of manufacturing the connection member, which includes exposing conductive wires at an end portion of an original band-shaped member, attaching a connection terminal for connection with an ECU and the like to the exposed conductive wires, and the like, and a connection structure having the conductive fabric and the connection member connected to the conductive fabric.

According to an illustrative embodiment of the present invention, there is provided a connection member which is electrically connected to a conductive fabric having conductive threads, the connection member comprising: a band-shaped part including conductive wires which extend in a longitudinal direction; and a connection terminal which is attached to an end portion of the conductive wires.

In the above configuration, the band-shaped part may be a woven fabric with warp and weft, and the conductive wires may configure a part of the warp and at least non-conductive threads may be used for the weft.

According to another illustrative embodiment of the present invention, there is provided a method of manufacturing the above connection member, the method comprising: forming an original band-shaped member by weaving while using the conductive wires for a part of warp and using at least non-conductive threads for weft; exposing the conductive wires at an end portion of the original band-shaped member; and attaching a connection terminal to the exposed conductive wires.

In the above configuration, in the exposing step, the conductive wires at the end portion of the original band-shaped member may be exposed by unthreading the non-conductive threads woven as the weft.

According to another illustrative embodiment of the present invention, there is provided a connection structure comprising: a conductive fabric having conductive threads which are exposed at an end portion of the conductive fabric; and the above connection member, wherein the conductive wires of the connection member are electrically connected to the conductive threads exposed from the conductive fabric.

According to the connection member as described above, since the connection terminal is attached to the exposed conductive wires in advance, when sewing a covering material, to which the conductive fabric having the connection member connected thereto is adhered, and the other covering material each other and thus manufacturing a seat cover of a vehicle, it is possible to easily perform the sewing and to easily connect the electric wire for power feeding. Also, since the connection terminal is directly attached to the conductive wires of the connection member, it is possible to reduce the number of parts, compared to a case where the conductive wires and the connection terminal are connected via a drawn lead wire. Furthermore, compared to a case where the connection terminal is attached after the seat cover is manufactured, it is possible to easily handle it and to increase the reliability of the connection by caulking and the like.

In addition, when the connection member is a band-shaped woven fabric and the conductive wires configure a part of the warp and at least non-conductive threads are used for the weft, it is possible to easily make a band-shaped connection member having a predetermined length.

According to the above method of manufacturing the connection member, since the original band-shaped member is used which is woven by using the conductive wires for a part of the warp and using at least non-conductive threads for the weft, it is easy to expose the conductive wires at the end portion of the original band-shaped member. As a result, it is possible to easily manufacture the connection member with simple process and convenient operation.

Also, in the exposing process, when the conductive wires of the end portion of the original band-shaped member are exposed by unthreading the non-conductive threads woven as the weft, it is possible to expose the conductive wires more easily with convenient operation.

According to the above connection structure, the conductive threads of the conductive fabric and the conductive wires of the connection member are connected and the connection structure is adhered on a backside of the covering material of a seat cushion and a seatback of a vehicle, particularly automobile. Thus, the connection structure can be useful for a heater member of a seat that can warm a passenger from lower body and the like under low temperature conditions such as winter.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Figure 1A:
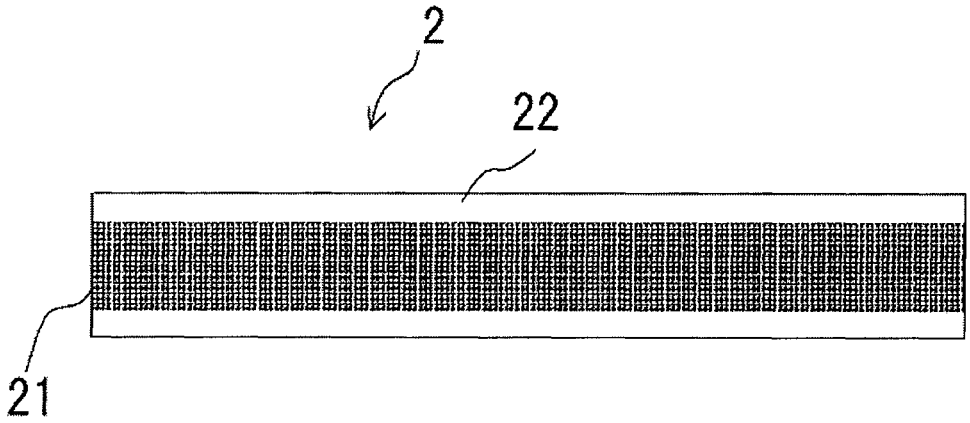
FIG. 1A is a plan view of an original band-shaped member that is used to manufacture a connection member according to an illustrative embodiment of the present invention.
Figure 1B:
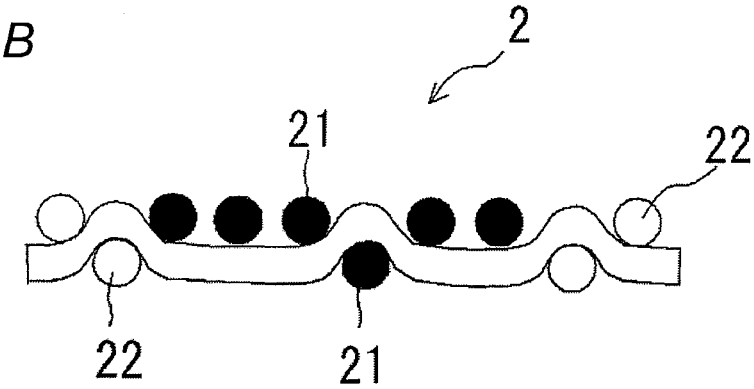
FIG. 1B is a schematic cross-sectional view of the original band-shaped member shown in FIG. 1A.

Hereinafter, illustrative embodiments of the present invention will be specifically described with reference to FIGS. 1A to 3.

The following description is just exemplary and is provided to exemplarily explain an illustrative embodiment of the present invention and to understand the gist and conceptual features of the present invention most efficiently and easily. Therefore, the structural details are not provided beyond the extent necessary for the basic understanding of the present invention, and one skilled in the art can clearly appreciate how illustrative embodiments of the present invention are actually implemented by the below descriptions referring to the drawings.

(1) Connection Member

Figure 2A:
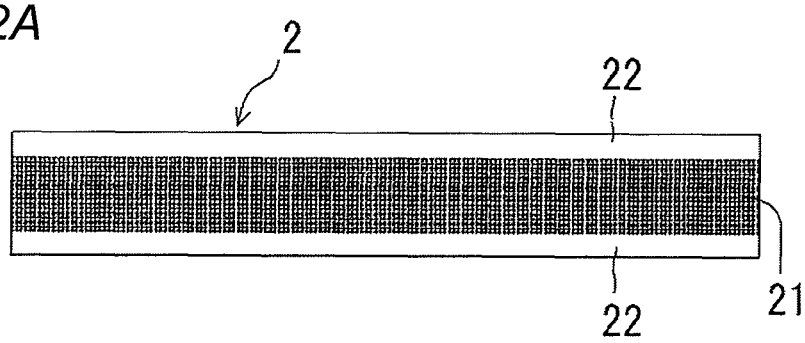
FIG. 2A is a plan view of an original band-shaped member that is used to manufacture a connection member according to an illustrative embodiment of the present invention.
Figure 2B:
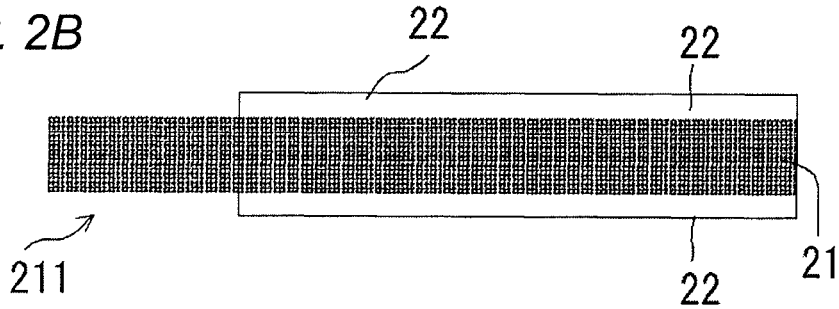
FIG. 2B is a schematic view for illustrating a state where a conductive wire at an end portion of the original band-shaped member is stripped and thus exposed.
Figure 2C:
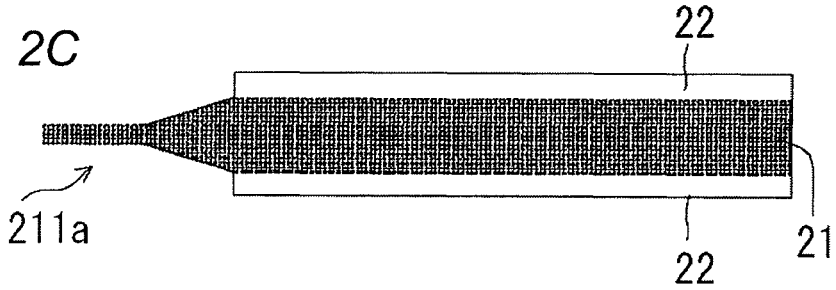
FIG. 2C is a schematic view for illustrating a twisted state of the exposed conductive wire.
Figure 2D:
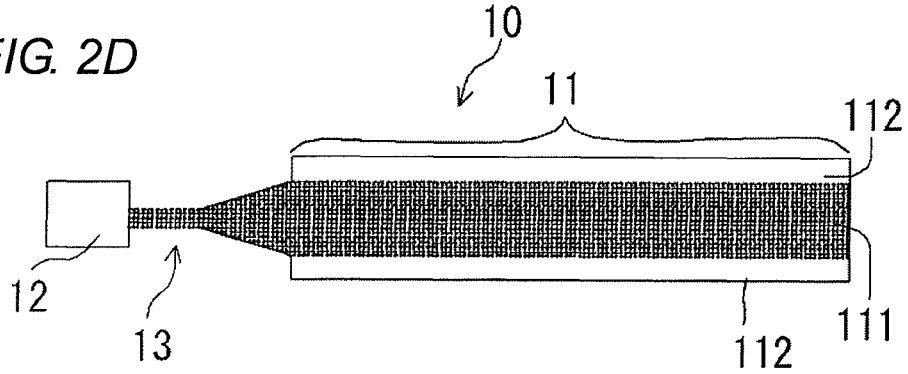
FIG. 2D is a plan view of a connection member according to an illustrative embodiment of the present invention, in which a connection terminal is attached to a leading end of the twisted conductive wire by caulking.
Figure 3:
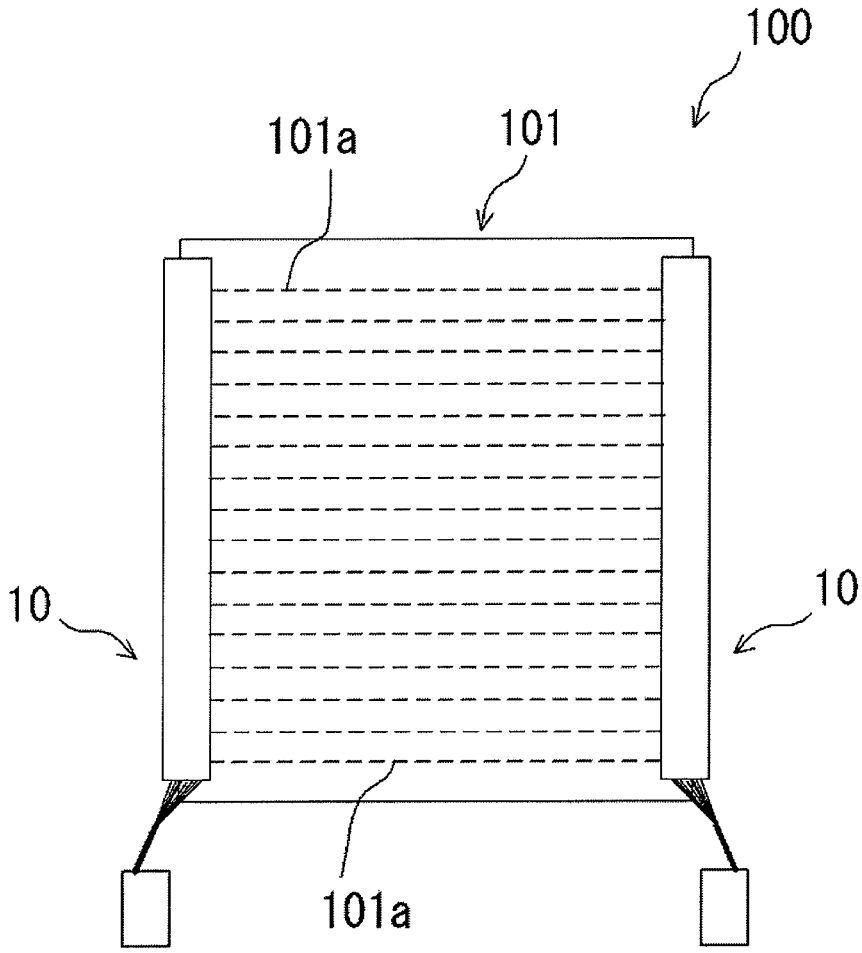
FIG. 3 is a plan view of a connection structure according to an illustrative embodiment of the present invention.

A connection member according to an illustrative embodiment (refer to a connection member 10 of FIG. 2D) is electrically connected to a conductive fabric (refer to a conductive fabric 101 of FIG. 3) having conductive threads (refer to conductive threads 101*a* of the conductive fabric 101 of FIG. 3), and has a band-shaped part (refer to a band-shaped part 11 of FIG. 2D) having conductive wires (refer to conductive wires 111 of the connection member 10 of FIG. 2D) arranged to extend in a longitudinal direction and a connection terminal (refer to a connection terminal 12 of FIG. 2D) attached to end portions of the conductive wires 111.

In the meantime, an intermediate part 13 of FIG. 2D is a part of a twisted part 211*a* of conductive wires 21 of FIG. 2C except for a leading end, to which the connection terminal 12 is connected and is positioned between the band-shaped part 11 and the connection terminal 12.

The connection member 10 has the band-shaped part 11 and the connection terminal 12. The band-shaped part 11 has a band-shaped insulation part and the conductive wires 111 arranged to extend in a longitudinal direction of the insulation part. The materials of the insulation part and the conductive wire 111, the arrangement shape of the conductive wires 111 and the like are not particularly limited. In addition, the band-shaped part 11 may be configured by woven fabric. In this case, the conductive wires 111 configure a part of the warp and non-conductive threads are normally used for the other part. Furthermore, at least non-conductive threads are used as the weft and the insulation part may be formed by the non-conductive thread. In addition to the non-conductive threads, the conductive threads and the like may be used as the weft. However, such configuration is not necessarily required and all of the weft may be configured by the non-conductive threads.

The conductive wires 111 feed the power, which is fed from an ECU and the like, to the conductive threads (refer to the conductive threads 101*a* of FIG. 3) of the conductive fabric 101 and generate heat for the same, and a material, a line diameter and the like thereof are not particularly limited. As the conductive wire 111, a conductive wire made of metal such as copper, aluminum, silver and the like and alloy such as copper alloy, aluminum alloy and the like may be used. It is preferable to use a conductive wire made of copper or aluminum, particularly a conductive wire made of copper due to the low cost and high conductivity. Also, a diameter of the conductive wire 111 may be 100~2000 μm, preferably 500~1500 μm, more preferably 500~1000 μm. When the diameter is 100~2000 μm, particularly 500~1000 μm, it is possible to directly caulk an electric wire and the like for power supply to the conductive threads 101*a* of the conductive fabric 101.

When the band-shaped part 11 is made of woven fabric, at least the non-conductive threads are used as the weft and the conductive threads are typically used also for the other part of the warp. The material of the non-conductive thread used for the woven fabric is not particularly limited and may include threads made of vegetable and animal natural fibers, recycled fiber such as rayon, semi-synthetic fiber such as acetate, synthetic fiber consisting of synthetic resin such as polyamide and polyester, and the like. One type of the non-conductive thread may be used and two or more types of the non-conductive threads may be used together. In the meantime, the non-conductive thread has typically a specific resistance of $10^8$ Ω·cm or higher and has insulating property.

The arrangement of the conductive wires in the connection member is not particularly limited. The conductive wires may be woven in a lump in a width direction of the connection member or may be dispersed. However, it is preferable that the conductive wires are woven in a lump. Also, when the conductive wires are woven in a lump, they may be woven at a central part or partially woven to one side. However, it is preferable that the conductive wires are woven at a central part. That is, it is preferable that the conductive wires are woven as the warp at the central part in a width direction of the connection member and the non-conductive threads are woven at both sides thereof. On the other hand, when the conductive wires are dispersed, only one line of the conductive wire may be woven between the non-conductive threads or a plurality of the conductive wires, for example two to ten lines, particularly two to five lines of the conductive wires may be consecutively woven between the non-conductive threads. Furthermore, when the conductive wires are dispersed, the conductive wires may be woven at a substantially equal interval or not.

As the connection terminal 12 attached to the end portions of the conductive wires 111, a connection terminal that is used for connection to an electric wire and the like may be used without particular limitation. As the connection terminal, a crimping terminal to which leading ends of twisted conductive wires are inserted, caulked and attached may be used. The crimping terminal may be covered with an insulation sheath or not. However, the crimping terminal is preferably covered with an insulation sheath. In addition, a bullet terminal or faston terminal consisting of a pair of two terminals that can be easily detachable may be used. Although not detachable, a crimping terminal having crimping strength higher than the bullet terminal or faston terminal may be also used. The terminals can be selectively used depending on uses of the connection member.

The intermediate part 13 is an intermediate part between the band-shaped part 11 and the connection terminal 12. When the conductive wires are twisted, the twisted part is the intermediate part. That is, it is the intermediate part between the band-shaped part 11 having the conductive wires 111 and the non-conductive threads 111 woven as the warp and the connection terminal 12 connected to the leading ends of the exposed conductive wires. Although a length of the intermediate part 13 is not particularly limited, when the exposed conductive wires 21 (refer to the exposed part 211 of the conductive wires 21 of FIG. 2B) are twisted, the intermediate part has such a length that allows the exposed conductive part to be easily twisted (refer to the twisted part 211*a* of FIG. 2C) and the leading end thereof to be connected to the connection terminal 12. That is, it is not necessarily to particularly lengthen the intermediate part. Also, the intermediate part 13 may be covered with an insulating material or not. However, it is preferable that the intermediate part is covered with the insulating material.

(2) Method of Manufacturing Connection Member

The method of manufacturing the connection member according to an illustrative embodiment of the present invention includes a weaving process of weaving the original band-shaped member (refer to the original band-shaped member 2 of FIGS. 1A, 1B and 2A) by using the conductive wires for a part of the warp and using at least the non-conductive threads for the weft, an exposing process of stripping and exposing the conductive wires 21 at the end portion of the original band-shaped member 2 (refer to the exposed part 211 of the conductive wires 21 of FIG. 2B) and a terminal attaching process of attaching the connection terminal to the exposed conductive wires (refer to the band-shaped part 11, the intermediate part 13 and the connection terminal 12 of FIG. 2D).

The weaving process is a process of weaving the original band-shaped member (refer to the original band-shaped member 2 of FIG. 2A), in which the conductive wires (refer to the conductive wire 21 of FIG. 2A) are used for a part of the warp and at least the non-conductive threads are used for the weft. The conductive wire 21 that is used for a part of the warp is the same as the conductive thread 111 of the connection member that has been described in the above section (1), and the above description can be also applied as it is. Similarly, the non-conductive threads may be typically used as the member of the other warp, the conductive thread may be used for the weft in addition to the non-conductive thread and the entire warp may consist of the non-conductive threads, which have been described in the above. Furthermore, regarding the material of the non-conductive thread, the above description can be applied as it is. In addition, regarding the arrangement of the conductive wires 21 in the original band-shaped member 2, the description about the arrangement of the conductive wires 111 in the connection member 10 of the above section (1) can be applied as it is.

The exposing process is a process of stripping and exposing the conductive wires of the end portion of the original band-shaped member 2, thereby forming the exposed part (refer to the exposed part 211 of FIG. 2B). The stripping and exposing of the conductive wires is to connect the connection terminal 12 to the exposed part 211. Accordingly, the exposed part 211 is not necessarily made of only the conductive wires 21 and a part of the non-conductive threads 22 woven as the warp may be mixed inasmuch as the connection terminal 12 can be connected to the exposed part. However, in order to provide the secure electrical connection with the low contact resistance, it is preferable that the non-conductive threads 22 and the like are mixed in the exposed part 211, or the entire exposed part 211 is preferably configured by the conductive wires 21.

Also, in order to electrically connect the connection terminal 12 securely with the low contact resistance, the exposed part 211 of the conductive wires 21 is preferably twisted to form the twisted part (refer to the twisted part 211*a* of FIG. 2C) and the connection terminal 12 is preferably connected to the leading end of the twisted part 211*a*. That is, when the twisted part 211*a* is formed, the non-conductive threads woven as the weft become an obstacle to the twisting and are thus required to be removed. In the meantime, when the twisted part 211*a* is formed, the twisting is possible even when the non-conductive threads 22 woven as the warp and the like are mixed. However, from standpoints of the easy twisting and the secure electrical connection with the low contact resistance, it is preferable to remove the non-conductive threads 22 woven as the warp and the like.

The method of stripping and exposing the conductive wires 21 of the end portion of the original band-shaped member 2 is not particularly limited. For example, the end portion of the original band-shaped member 2 may be heated to melt the non-conductive material such as non-conductive threads 22 or to burn and remove the same. Since the non-conductive thread 22 that is a non-conductive material has the lower melting point or is burned at the lower temperatures, compared to the conductive wire, it is possible to easily remove the same by the heating. The heating means is not particularly limited. For example, a method of contacting a heat generation member whose temperature is increased by electric heating, a method of illuminating laser such as carbon dioxide gas laser and YAG laser, eximer laser, and the like may be used. However, it is preferable to use the method of illuminating the laser.

Furthermore, the conductive wires 21 of the end portion of the original band-shaped member 2 may be exposed by unthreading the non-conductive threads woven as the weft. In this case, the non-conductive threads 22 woven as the warp and the like may be removed as described above or not, but preferably removed. Also, the conductive wires 21 of the end portion of the original band-shaped member 2 may be exposed by inserting a comb-shaped blade into a predetermined position (a leading end side of the position becomes the end portion) of the original band-shaped member 2 in the longitudinal direction and moving the blade to the leading end side to remove the non-conductive threads. By doing so, it is possible to remove not only the non-conductive threads woven as the warp but also the non-conductive threads woven as the weft at the same time.

(3) Connection Structure

The connection structure according to an illustrative embodiment of the present invention (refer to the connection structure 100 of FIG. 3) has such a configuration that the conductive wires of the above connection members (refer to the connection members 10 of FIGS. 2D and 3) are electrically connected to the conductive threads (refer to the conductive threads 101*a* of the conductive fabric 101 of FIG. 3) exposed at the end portions of the conductive fabric (refer to the conductive fabric 101 of FIG. 3). Regarding the connection member and the conductive wire, the respective descriptions in the above section (1) connection member can be applied.

The conductive fabric may be woven fabric or knitted fabric. The woven fabric is not particularly limited and may be any woven texture such as plain weave, twill weave, stain weave and the like. In addition, the knitted fabric is not particularly limited and may be any knitted texture such as weft knit and warp knit. Furthermore, the material of the non-conductive threads that are used for the woven fabric and knitted fabric is not also particularly limited and the threads that are made of natural fibers, recycled fiber, semi-synthetic fiber, synthetic fiber consisting of synthetic resin and the like, which are used as the weft and warp when the band-shaped part of the connection member is the woven fabric, may be used. One type of the non-conductive thread may be used and two or more types of the non-conductive threads may be used together. In the meantime, the non-conductive thread has typically a specific resistance of $10^8$ Ω·cm or higher and has insulating property.

The conductive thread (refer to the conductive thread 101*a* of FIG. 3), which is used as a part of the threads configuring the woven fabric and knitted fabric, is a conductive fabric-like material that can enable the current to flow. In particular, the conductive thread having a specific resistance (volume resistivity) of 100 to $10^{-12}$ Ω·cm, which is measured based on JIS K 7194, may be used. The conductive thread may include a metal wire, a plated wire member and a filament of carbon fiber, for example.

The metal wire may include a wire member made of gold, silver, copper, brass, platinum, iron, steel such as stainless steel and heat-resistant steel, zinc, tin, nickel, aluminum, tungsten and the like. Among them, the metal wire made of stainless steel is preferable because it has excellent corrosion resistance and strength. The stainless steel is not particularly limited and may include SUS304, SUS316, SUS316L and the like. SUS304 having high general versatility is preferable and SUS316 and SUS316L containing molybdenum are also preferable due to the excellent corrosion resistance.

A diameter of the metal wire is not particularly limited. However, from standpoints of strength and flexibility, the diameter is preferably 10 to 150 μm, particularly 20 to 60 μm. Furthermore, as the metal wire, a complex thread, which is made by providing the other fiber material such as polyester fiber as a core thread, forming a metal wire as a sheath thread and winding the metal wire in at least one twisting direction of S and Z, may be used. In this case, when a metal wire having a small diameter is used, it is possible to make a conductive thread having excellent flexibility and sufficient tensile strength due to the core thread.

Also, as the metal wire, it is possible to use a metal wire having a resin coating (electrically insulating sheath) on a surface thereof. Since the metal wire is protected by the covered resin layer, it has excellent rust-proof property. Furthermore, when connecting the exposed part of the conductive threads and the conductive wires, the resin layer is stripped to expose the metal wire, which is then electrically connected securely. The resin that is used for the coating is not particularly limited, and may include polyurethane resin, acrylic resin, silicon resin, polyester resin and the like. From a standpoint of durability, the polyurethane resin is preferable.

A thickness of the resin layer can be set, based on types and durability of the resin, uses of the conductive fabric and the like, and may be 0.05 to 500 μm, particularly 1 to 10 μm, for example. Also, the method of coating the resin is not particularly limited. For example, a method of dipping a metal wire in a resin dispersion solution or enabling the metal wire to pass through the solution, attaching the resin dispersion solution to the metal wire, heating the same to remove the medium and cooling and solidifying the same may be exemplified. Also, a method of attaching resin powders to a metal wire and heating, cooling and fixing the same is possible. In addition, a method of fusing melted resin onto a metal wire and heating, cooling and fixing the same, as required, is possible.

As the plated wire member, a wire member including a non-conductive or conductive fiber material as a core material and a plated layer formed on an entire surface of the core material or a part thereof in a width direction over an entire length and made of single metal or alloy may be used. Accordingly, by forming the plated layer on the surface of the core material, the wire member can be used as the conductive thread even when the core material is a non-conductive fiber material. In the meantime, when the core material is a conductive fiber material, it is possible to increase the durability by forming the plated layer.

The conductive fiber that can be used as the core material of the plated wire member may include a variety of metal fibers and the like. In the meantime, the non-conductive fiber may include para-aramid fiber, meta-aramid fiber, poly arylate fiber, poly phenylene sulfide fiber, polyether ether ketone fiber, polyimide fiber, glass fiber, alumina fiber, silicon carbide fiber, boron fiber and the like. In addition, the metal that is used for the plating may include single metal such as tin, nickel, gold, silver, copper, iron, lead, platinum, zinc, chrome, cobalt, palladium and the like and alloy such as nickel-tin, copper-nickel, copper-tin, copper-zinc, iron-nickel and the like.

The carbon fiber that is used for the conductive thread may include polyacrylonitrile-based carbon fiber (PAN-based carbon fiber), pitch-based carbon fiber and the like. Among them, the carbon fiber that is manufactured at firing temperatures of 1,000° C. or higher such as carbonized fiber, graphitized fiber, graphite fiber and the like is preferable due to its excellent electrical conductivity.

Compared to the non-conductive thread used for the conductive fabric, the various conductive threads have preferably the high heat resistance. In other words, the conductive thread has the higher temperature, at which it is melted by the heating, than the non-conductive thread. When the conductive thread is burned without being melted, it has the higher burning start temperature that the non-conductive thread. That is, preferably, the conductive thread has the higher melting temperature or is not burned well, compared to the non-conductive thread. As an index of the burning quality, the limiting oxygen index (LOI) that is measured based on the JIS K 7201 and JIS L 1091(1999) 8.5E-2 method can be used, and a conductive thread having the LOI of 26 or greater is preferably used. Among the conductive threads, the metal wire has the higher melting temperature than the natural fiber and synthetic fiber used as the non-conductive thread, and the LOT of 26 or greater. For example, the stainless steel fiber has the LOI of 49.6. Also, the carbon fiber is not melted and has the LOT of 60 or greater.

The non-conductive thread has the lower temperature, at which it is melted by the heating, than the conductive thread. When the non-conductive thread is burned without being melted, it has the lower burning start temperature than the conductive thread. The non-conductive thread that is burned without being melted has preferably the LOI smaller than 26. Many natural fibers have the LOI smaller than 26. For example, cotton has the LOT of 18 to 20 and wool has the LOI of 24 to 25. Furthermore, the synthetic fiber has the lower melting point than the conductive thread and has the higher burning quality than the conductive thread, in many cases. For example, the polyester fiber has the LOI of 18 to 20 and the polyamide fiber has the LOI of 20 to 22.

An interval of the conductive thread in the non-conductive thread woven or knitted as the thread of configuring the woven fabric or knitted fabric is not particularly limited. However, when the connection structure is used as a heater member of a seat cushion of an automobile, for example, the interval is preferably 2 to 100 mm, particularly 5 to 50 mm. When the interval is narrow, it is possible to equally warm. However, the current per one conductive thread is smaller, so that the temperature is decreased, and when the voltage is increased so as to increase the temperature, the power consumption is increased. On the other hand, when the interval is wide, the current per one conductive thread is larger, so that the temperature is increased, and the voltage can be thus decreased to reduce the power consumption. However, since the interval is wide, the non-uniformity of the temperature may easily occur on a surface of the seat cushion.

Also, the arrangement of the conductive threads in the conductive fabric is not particularly limited. The conductive threads may be woven or knitted at a substantial equal distance or not. When the conductive thread are woven or knitted at a substantial equal distance, it is possible to warm the entire surface of the conductive fabric more equally. In the meantime, when it is intended to sufficiently increase the temperature of a specific part of the conductive fabric, it is possible to arrange the conductive threads relatively densely in the corresponding part and to arrange the conductive threads relatively sparsely in the other parts.

Also, only one line of the conductive thread may be woven or knitted between the non-conductive threads or a plurality of the conductive threads, for example two to ten lines, particularly two to five lines of the conductive threads may be consecutively woven or knitted between the non-conductive thread. Also in this case, the conductive threads continuously woven or knitted may be arranged at an equal distance or at a non-equal distance in the conductive fabric. That is, it is possible to equally warm the entire surface of the conductive fabric or to sufficiently warm the specific part thereof by adjusting the arrangement interval of the conductive threads or the number of lines of the conductive threads when continuously weaving or knitting the conductive threads.

(4) Exposing of Conductive Thread

The conductive wires 111 (refer to the conductive wire 111 of FIG. 2D) of the connection member 2 are connected to the conductive threads (end portions of the conductive threads 101*a*) exposed at the end portions of the conductive fabric 101, the conductive wires 111 are connected to an ECU (not shown) via the connection terminals 12 (refer to the connection terminals 12 of FIG. 2D) and the electric wires such as wirings and the conductive threads 101*a* generate heat by the power fed from the power supply, so that the temperature of the conductive fabric 101 is increased. In this case, the woven or knitted non-conductive thread and the covering material having an electrically insulating sheath covered on the conductive thread are mixed at the end portion of the conductive fabric 101, at which the conductive threads 101*a* are exposed, and it is necessary to remove the non-conductive material before connecting the exposed conductive threads 101*a* and the conductive wires 111.

The non-conductive material can be removed by heating and melting the end portion of the conductive fabric or burning the same. Since the non-conductive thread and the covering material, which are the non-conductive materials, have the lower melting points or are burned at the lower temperatures, compared to the conductive-thread, it is possible to easily remove the same by the heating. The heating means is not particularly limited. For example, like the method of stripping and exposing the conductive wires 21 of the end portion of the original band-shaped member 2, the method of contacting a heat generation member whose temperature is increased by electric heating, the method of illuminating laser and the like may be used. However, it is preferable to use the method of illuminating the laser.

According to the laser illuminating method, it is possible to easily adjust the intensity and output of the laser into levels necessary for the melting and burning of the non-conductive material, depending on the material quality and the like of the non-conductive material, so that it is possible to remove the non-conductive material easily and efficiently. Furthermore, the laser may be illuminated from any surface of the conductive fabric and may be illuminated to the surface of the conductive fabric with a focus position being deviated, so that it is possible to widely process the conductive fabric at a time. Also, it is possible to remove the non-conductive material into a band shape by reciprocally illuminating the laser in the longitudinal direction of the conductive fabric. In addition, it is possible to prevent or at least to suppress the oxidation and deterioration of the conductor due to the overheating by ejecting the inert gas such as nitrogen gas, helium gas and the like together with the illumination of the laser.

The entire non-conductive material of the end portion of the conductive fabric may be removed by the heating. However, it is not easy to remove the whole surface of the end portion of the conductive fabric by heating and thus melting or burning the same. Accordingly, it is preferable to remove the non-conductive material into a band shape in the longitudinal direction of the conductive fabric at a boundary between a main body and the end portion of the conductive fabric, to pull out the end portion side from the conductive thread in an outward direction and to thus remove all the non-conductive materials of the end portions of the conductive fabric at a time. By doing so, it is possible to efficiently remove the non-conductive materials.

As described above, when removing the non-conductive material of the boundary into a band shape in the longitudinal direction and then pulling out and removing the other non-conductive material from the conductive thread, it is preferable that the respective end portions of the conductive threads are not knitted and tacked, i.e., are substantially straight. Alternatively, it is preferable to reduce the knits and tacks as much as possible so that many parts are straight. Like this, when the respective exposed parts of the conductive threads are straight or most of the exposed parts are straight, it is possible to easily pull out and remove the non-conductive material from the conductive threads (the conductor from which the covering material has been removed when the covering material is covered), so that it is possible to expose the conductive threads easily and securely.

(5) Connection of Conductive Threads of Conductive Fabric and Conductive Wires of Connection Member The method of connecting the exposed conductive threads of the conductive fabric and the exposed conductive wires of the connection member is not particularly limited. For example, a method of adhering or sewing the connection members to both end portions of the conductive fabric with the conductive threads and the conductive wires being contacted may be possible. The adhering method may include a welding method and an adhering method of using an adhesive. Since the welding can fix the connection member more strongly, it is preferably to weld and connect the connection member, if the welding is possible. Also, after the adhesion, the sewing may be further performed. By doing so, it is possible to fix the connection member more strongly and to electrically connect the same more securely. Furthermore, the exposed conductive threads and the exposed conductive wires can be connected with being pressurized by an insulation member made of an insulation material such as synthetic resin and having a specific structure.

In addition, when the connection structure is adhered on the backside of the covering material and is used for a seat cushion of an automobile, for example, a position of the connection part of the exposed conductive threads and the exposed conductive wires in the width direction of the seat cushion is not particularly limited. However, when the connection part is arranged at a position of the seat cushion to which a passenger's hip, femoral region and the like is contacted, the passenger may feel hard and thus discomfort. Furthermore, regarding a seatback, when the connection part is arranged at a position of the seatback to which a passenger's shoulder, back and the like is contacted, the passenger may feel hard and thus discomfort. Therefore, it is preferable that the connection part is arranged at a more outer position than a sewing part between the covering material and the other member such as side material adjacent to the covering material. By doing so, it is possible to improve the durability while a sitting passenger does not feel discomfort.

While the present invention has been shown and described with reference to certain illustrative embodiments thereof, it will be understood by those skilled in the art that various changes in form and details may be made therein without departing from the spirit and scope of the invention as defined by the appended claims. That is, the present invention also encompasses the structure, methods and uses functionally equivalent to the claims.

The present invention can be applied to a variety of products that are necessary to be warmed by increasing the temperatures, such as the seat cushion and seatback for an automobile, a hot carpet, an electric blanket, an electromotive massage seat for domestic use, jackets having heaters for outdoors and motorbike and the like. In particular, the invention is useful for a heater member warming a product that is used outdoors, such as seat for a vehicle, for example automobile.

What is claimed is:

1. A connection member which is electrically connected to a conductive fabric having conductive threads, the connection member comprising:

a band-shaped part including conductive wires which extend in a longitudinal direction; and a connection terminal which is attached to an end portion of the conductive wires, wherein the band-shaped part is a woven fabric with warp and weft, wherein the conductive wires configures a part of the warp and at least non-conductive threads are used for the weft, and wherein the conductive wires are woven such that the conductive wires are exposed outside of the connection member to be electrically connected to the conductive threads of the conductive fabric.

2. The connection member according to claim 1, wherein the warp of the band-shaped part includes the conductive wires and non-conductive threads.

3. The connection member according to claim 2, wherein a plurality of conductive wires are provided between adjacent non-conductive threads in the warp.

4. A connection structure comprising:

a conductive fabric having conductive threads which are exposed at an end portion of the conductive fabric; and a connection member including:

a band-shaped part including conductive wires which extend in a longitudinal direction; and a connection terminal which is attached to an end portion of the conductive wires, wherein the band-shaped part is a woven fabric with warp and weft, wherein the conductive wires configures a part of the warp and at least non-conductive threads are used for the weft, and wherein the conductive wires of the connection member are woven such that the conductive wires are exposed to and electrically connected to the conductive threads exposed from the conductive fabric.

5. The connection member according to claim 1, wherein the conductive wires are woven at a central part of the band-shaped part and the non-conductive threads are woven on opposite sides of the central part.

6. The connection member according to claim 5, wherein the conductive wires are woven at a central part of the band-shaped part and the non-conductive threads are woven on opposite sides of the central part.

* * * * *